US011980294B2

(12) United States Patent
Wang et al.

(10) Patent No.: US 11,980,294 B2
(45) Date of Patent: May 14, 2024

(54) LUMBAR SUPPORT MECHANISM AND ADJUSTABLE BED THEREWITH

(71) Applicant: Nisco Co., Ltd, Jiangsu (CN)

(72) Inventors: Wei Wang, Jiangsu (CN); Fahuan Zhang, Jiangsu (CN); Jian Xie, Jiangsu (CN); Yifan Mao, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 386 days.

(21) Appl. No.: 17/462,191

(22) Filed: Aug. 31, 2021

(65) Prior Publication Data

US 2021/0393043 A1 Dec. 23, 2021

Related U.S. Application Data

(63) Continuation-in-part of application No. 17/318,006, filed on May 12, 2021, now Pat. No. 11,839,307, (Continued)

(30) Foreign Application Priority Data

Jul. 5, 2021 (CN) ..... 202121521952.X

(51) Int. Cl.

| | |
|---|---|
| ***A47C 20/04*** | (2006.01) |
| ***A47C 19/02*** | (2006.01) |
| ***A47C 20/12*** | (2006.01) |

(52) U.S. Cl.

CPC ..... *A47C 20/041* (2013.01); *A47C 19/025* (2013.01); *A47C 20/12* (2013.01)

(58) Field of Classification Search

CPC ..... A47C 20/12; A47C 20/041; A47C 20/027; A47C 7/462; A47C 19/025; A61G 7/07; A61G 7/015

See application file for complete search history.

(56) References Cited

U.S. PATENT DOCUMENTS 9,808,093 B2 * 11/2017 Rawls-Meehan ..... A47C 20/04
11,224,294 B2 * 1/2022 Nava ..... A47C 20/041
(Continued)

FOREIGN PATENT DOCUMENTS

WO WO-2018040719 A1 * 3/2018 ..... A47C 19/04

*Primary Examiner* — Justin C Mikowski
*Assistant Examiner* — Alison N Labarge
(74) *Attorney, Agent, or Firm* — Locke Lord LLP; Tim Tingkang Xia, Esq.

(57) ABSTRACT

The lumbar support mechanism and an adjustable bed having the same. The lumbar support mechanism includes first and second lumbar lifting assemblies. Each lumbar lifting assembly has a fixing bracket, a first support leg, a second support leg, a bearing member, and a lifting support bracket. The first support leg is pivotally connected between the bearing member and the lifting support bracket. The second support leg is pivotally connected between the fixing bracket and the first support leg. A lumbar support member is connected to the lifting support brackets of the first and second lumbar lifting assemblies. A linkage member is pivotally connected to the bearing members of the first and second lumbar lifting assemblies such that the lumbar support member is operably movable between a retracted position and an ejected position when the linkage member moves between first and second positions.

17 Claims, 10 Drawing Sheets

Related U.S. Application Data which is a continuation-in-part of application No. 16/729,700, filed on Dec. 30, 2019, now Pat. No. 11,317,729.

(60) Provisional application No. 63/029,800, filed on May 26, 2020, provisional application No. 62/790,583, filed on Jan. 10, 2019, provisional application No. 62/789,047, filed on Jan. 7, 2019, provisional application No. 62/789,062, filed on Jan. 7, 2019.

(56) References Cited

U.S. PATENT DOCUMENTS

| | | | | |
|---|---|---|---|---|
| 2009/0178201 | A1* | 7/2009 | Lujan | A61G 7/07 5/630 |
| 2011/0101749 | A1* | 5/2011 | Shih | A47C 7/425 297/284.7 |
| 2013/0145553 | A1* | 6/2013 | Shih | A61G 7/015 5/624 |
| 2014/0000033 | A1* | 1/2014 | Clenet | A61G 7/072 5/613 |
| 2017/0215589 | A1* | 8/2017 | Bullard | A47C 7/462 |
| 2020/0154899 | A1* | 5/2020 | Brown | A47C 20/12 |
| 2020/0237101 | A1* | 7/2020 | Liu | A47C 20/041 |

* cited by examiner

LUMBAR SUPPORT MECHANISM AND ADJUSTABLE BED THEREWITH

CROSS-REFERENCE TO RELATED PATENT APPLICATIONS

This application claims priority to and benefit of Chinese Patent Application Ser. No. 202121521952.X, filed Jul. 5, 2021, which is incorporated herein in its entirety by reference.

This application is also a continuation-in-part application of U.S. patent application Ser. No. 17/318,006, filed May 12, 2021, now U.S. Pat. No. 11,839,307, which claims priority to and the benefit of U.S. Provisional Patent Application Ser. No. 63/029,800, filed May 26, 2020, and is a continuation-in-part application of U.S. patent application Ser. No. 16/729,700, filed Jan. 30, 2019, now U.S. Pat. No. 11,317,729, which itself claims priority to and the benefit of U.S. Provisional Patent Application Ser. No. 62/789,062 filed Jan. 7, 2019, 62/789,047 filed Jan. 7, 2019, and 62/790,583 filed Jan. 10, 2019, which are incorporated herein in their entireties by reference.

FIELD OF THE INVENTION

The invention generally relates to a bed, and more particular to a lumbar support mechanism and an adjustable bed having the same.

BACKGROUND OF THE INVENTION

Sleep is critical for people in every aspect of their lives. Beds are necessary furniture for people to sleep on. Adjustable beds are used more and more in healthcare and home. However, the adjustability of conventional adjustable beds is very limited. Thus, it would be beneficial and desirable for people to have a bed system that is capable of adjusting body positions at user's preference so that the user achieves maximum comfort when using the bed system.

SUMMARY OF THE INVENTION

This invention, in one aspect, relates to a lumbar support mechanism usable in an adjustable bed. In one embodiment, the lumbar support mechanism comprises a first lumbar lifting assembly and a second lumbar lifting assembly.

Each of the first and second lumbar lifting assemblies comprises a fixing bracket, a first support leg, a second support leg, a bearing member, and a lifting support bracket. The fixing bracket is operably attachable to a back platform of the adjustable bed. The first support leg has a lower end portion pivotally connected to the bearing member that is operably movable in the fixing bracket, and an upper portion pivotally connected to the lifting support bracket. The second support leg has a lower end portion pivotally connected to the fixing bracket, and an upper end portion pivotally connected to a middle portion of the first support leg.

The lumbar support mechanism also comprises a lumbar support member connected to the lifting support brackets of the first lumbar lifting assembly and the second lumbar lifting assembly; and a linkage member pivotally connected to the bearing member of the first lumbar lifting assembly and the second lumbar lifting assembly.

As such, a distance between the lumbar support member and the lifting support brackets of the first lumbar lifting assembly and the second lumbar lifting assembly is operably changeable between a minimal distance and a maximal distance when the linkage member moves between a first position and a second position.

In one embodiment, the fixing bracket has a bottom wall, two sidewalls vertically extended from two opposite edges of the bottom wall, a plurality of mounting tabs horizontally extended from tops of the sidewalls, and at least one guiding slot formed in at least one of the sidewalls and being parallel to the bottom wall.

In one embodiment, the bearing member is operably movable on the bottom wall of the fixing bracket.

In one embodiment, the bearing member comprises at least one sliding block.

In one embodiment, the bearing member comprises at least one roller disposed between the lower end portion of the first support leg and the at least one of the sidewalls of the fixing bracket, and a shaft connected to the at least one roller and the lower end portion of the first support leg as a pivot and movably received in the at least one guiding slot of the fixing bracket, such that when the lower end portion of the first support leg is driven to move in the fixing bracket, the shaft moves along the at least one guiding slot of the fixing bracket and the at least one roller rotates on the bottom wall of the fixing bracket.

In one embodiment, two end portions of the linkage member are pivotally connected to the shafts of the bearing members of the first lumbar lifting assembly and the second lumbar lifting assembly, respectively, such that when the shaft moves to a first end of the at least one guiding slot, the linkage member moves to the first position, when the shaft moves to an opposite, second end of the at least one guiding slot, the linkage member moves to the second position.

In one embodiment, the lumbar support mechanism further comprises a lumbar support actuator operably connected to the bearing member of one of the first lumbar lifting assembly and the second lumbar lifting assembly for operably driving the bearing members so as to move the linkage member between the first position and the second position.

In one embodiment, the lumbar support actuator comprises a motor member, an outer tube extending from the motor member, and an activation rod received in the outer tube, engaged with the motor member and configured to be telescopically movable relative to the outer tube according to a rotation direction of the motor member.

In one embodiment, the lumbar support actuator further comprises a mounting bracket connected to the motor member and configured to attach to the back platform. A distal end of the activation rod is pivotally connected to the lower end portion of the first support leg, or pivotally connected to the shaft of said one of the bearing members of the first lumbar lifting assembly and the second lumbar lifting assembly.

In another aspect, the invention relates to an adjustable bed comprising a frame structure having a back frame and a foot frame; a plurality of platforms disposed on the frame structure, the plurality of platforms comprising at least a back platform having at least one opening; and a lifting mechanism positioned between the frame structure and the plurality of platforms for operably adjusting positions of at least one of the plurality of platforms so as to adjust the adjustable bed at a desired position; and a lumbar support mechanism received in the at least one opening of and secured to the back platform for operably providing lumbar support.

In one embodiment, the lumbar support mechanism comprises a first lumbar lifting assembly and a second lumbar lifting assembly. Each of the first and second lumbar lifting assemblies comprises a fixing bracket, a first support leg, a second support leg, a bearing member, and a lifting support bracket. The fixing bracket is secured to the back platform. The first support leg has a lower end portion pivotally connected to the bearing member that is operably movable in the fixing bracket, and an upper portion pivotally connected to the lifting support bracket. The second support leg has a lower end portion pivotally connected to the fixing bracket, and an upper end portion pivotally connected to a middle portion of the first support leg.

The lumbar support mechanism also comprises a lumbar support member connected to the lifting support brackets of the first lumbar lifting assembly and the second lumbar lifting assembly; a linkage member pivotally connected to the bearing member of the first lumbar lifting assembly and the second lumbar lifting assembly; and a lumbar support actuator pivotally connected to the bearing member of one of the first lumbar lifting assembly and the second lumbar lifting assembly for operably driving the bearing members so as to move the linkage member between a first position and a second position.

The lumbar support member is operably movable between a retracted position and an ejected position when the linkage member moves between the first and second positions. The lumbar support is provided when the lumbar support member is in the ejected position.

In one embodiment, the fixing bracket has a bottom wall, two sidewalls vertically extended from two opposite edges of the bottom wall, a plurality of mounting tabs horizontally extended from tops of the sidewalls, and at least one guiding slot formed in at least one of the sidewalls and being parallel to the bottom wall. The bearing member is operably movable on the bottom wall of the fixing bracket.

In one embodiment, the bearing member comprises at least one roller disposed between the lower end portion of the first support leg and the at least one of the sidewalls of the fixing bracket, and a shaft connected to the at least one roller and the lower end portion of the first support leg as a pivot and movably received in the at least one guiding slot of the fixing bracket, such that when the lower end portion of the first support leg is driven to move in the fixing bracket, the shaft moves along the at least one guiding slot of the fixing bracket and the at least one roller rotates on the bottom wall of the fixing bracket.

In one embodiment, two end portions of the linkage member are pivotally connected to the shafts of the bearing members of the first lumbar lifting assembly and the second lumbar lifting assembly, respectively, such that when the shaft moves to a first end of the at least one guiding slot, the linkage member moves to the first position, when the shaft moves to an opposite, second end of the at least one guiding slot, the linkage member moves to the second position.

In one embodiment, the lumbar support actuator comprises a motor member, an outer tube extending from the motor member, an activation rod received in the outer tube, engaged with the motor member and configured to be telescopically movable relative to the outer tube according to a rotation direction of the motor member, and a mounting bracket connected to the motor member and configured to attach to the back platform. A distal end of the activation rod is pivotally connected to the lower end portion of the first support leg, or pivotally connected to the shaft of said one of the bearing members of the first lumbar lifting assembly and the second lumbar lifting assembly.

In one embodiment, the lifting mechanism comprises a back lifting assembly and a leg lifting assembly.

In one embodiment, the back lifting assembly comprises a back lifting bracket pivotally connected to the back frame, and a back lifting actuator pivotally connected between the back lifting bracket and the back frame for operably driving the back lifting bracket to pivotally move in an upward rotating direction or a downward rotating direction relative to the back frame.

In one embodiment, the back lifting actuator comprises a motor member, an outer tube extending from the motor member, and an activation rod having a first end portion received in the outer tube and an opposite, second end portion. The activation rod is engaged with the motor member and configured to be telescopically movable relative to the outer tube according to a direction of motor rotation. The motor member is pivotally connected to the back frame and the second end portion of the activation rod pivotally connected to the back lifting bracket, or the motor member is pivotally connected to the back lifting bracket and the second end portion of the activation rod pivotally connected to the back frame.

In one embodiment, the foot lifting assembly comprises a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction relative to the foot frame.

In one embodiment, the leg lifting actuator comprises a motor member, an outer tube extending from the motor member, and an activation rod having a first end portion received in the outer tube and an opposite, second end portion. The activation rod is engaged with the motor member and configured to be telescopically movable relative to the outer tube according to a direction of motor rotation. The motor member is pivotally connected to the leg frame and the second end portion of the activation rod pivotally connected to the leg lifting bracket, or the motor member is pivotally connected to the leg lifting bracket and the second end portion of the activation rod pivotally connected to the leg frame.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
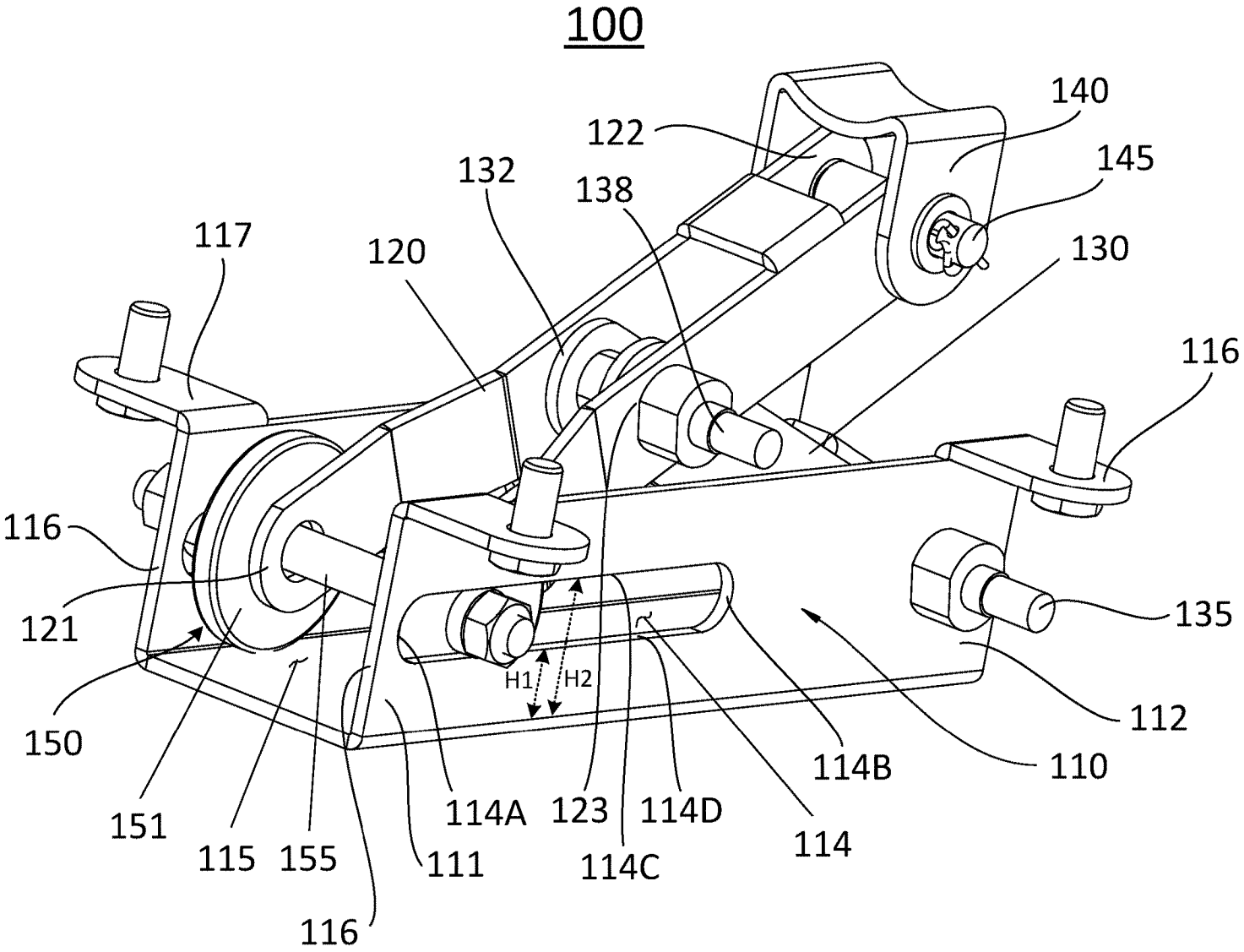
FIG. 1 shows schematically a perspective view of a lumbar lifting assembly of a lumbar support mechanism usable in an adjustable bed according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

As used in this specification, the term "platform" refers to a bed board or a bed panel.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

In accordance with the purposes of this invention, as embodied and broadly described herein, this invention, in one aspect, relates to a lumbar support mechanism and an adjustable bed having the same.

Referring to FIGS. 1-10, and particularly to FIGS. 1-5, the lumbar support mechanism is shown according to one embodiment of the invention. The lumbar support mechanism comprises a first lumbar lifting assembly 100, a second lumbar lifting assembly 100', a lumbar support actuator 230, a lumbar support member 240, and a linkage member 250.

The first lumbar lifting assembly 100 and the second lumbar lifting assembly 100' can be identical or substantially different. The following description illustrates the embodiment of which the first and second lumbar lifting assemblies 100 and 100' are identical. The same principles apply in the different first and second lumbar lifting assemblies.

Figure 2:
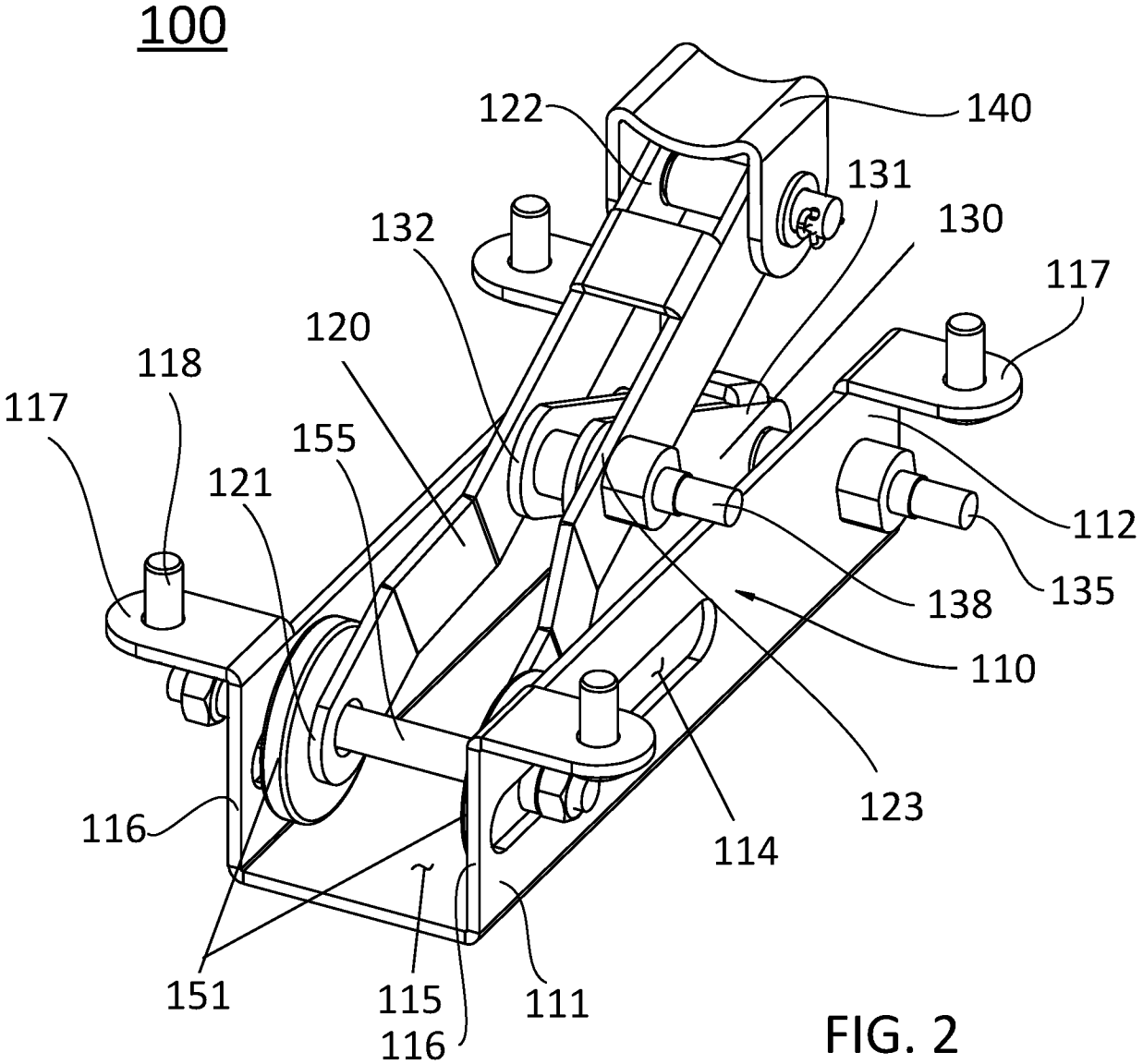
FIG. 2 shows schematically another perspective view of the lumbar lifting assembly shown in FIG. 1.

As shown in FIGS. 1-2, each lumbar lifting assembly 100/100' comprises a fixing bracket 110, a first support leg 120, a second support leg 130, a lifting support bracket 140, and a bearing member 150.

The fixing bracket 110 has a bottom wall 115, two sidewalls 116 vertically extended from two opposite, lateral edges of the bottom wall 115, a plurality of mounting tabs 117 horizontally extended from the tops of the sidewalls 116, and two guiding slots 114 each of which is formed in a respective sidewall 116 and parallel to the bottom wall 115. Each guiding slots 114 has a first end 114A proximal to the front end 111 of the sidewall 115, and a second end 114B distal to the front end 111 of the sidewall 115. The fixing bracket 110 is operably attachable to a back platform of the adjustable bed, e.g., through mounting the plurality of mounting tabs 117 onto the rear surface of the back platform by screws or pins 118, or other mounting means.

The first support leg 120 has a lower end portion 121 pivotally connected to the bearing member 150 that is operably movable on the bottom wall 115 of the fixing bracket 110 in the length direction, and an upper portion 122 pivotally connected to the lifting support bracket 140 through a pivotal shaft 145. The lifting support bracket 140 is used to set or place objects that need to be lifted.

The second support leg 130 has a lower end portion 131 pivotally connected to the fixing bracket 110 through a pivotal shaft 135 proximal to the rear end 112 of the of the sidewall 115, and an upper end portion 132 pivotally connected to a middle portion 123 of the first support leg 120 through a pivotal shaft 138.

The bearing member 150 comprises at least one roller 151 disposed between the lower end portion 121 of the first support leg 120 and the at least one of the sidewalls 116 of the fixing bracket 110, and a shaft 155 connected to the at least one roller 151 and the lower end portion 121 of the first support leg 120 as a pivot and movably received in the at least one guiding slot 114 of the fixing bracket 110. In the exemplary embodiment shown in FIGS. 1-2, the bearing member 150 has two rollers 151, each of which is disposed between the outer surface of the lower end portion 121 of the first support leg 120 and the inner surface of the respective sidewall 116 of the fixing bracket 110. Preferably, each roller 151 is in contact with the outer surface of the lower end portion 121 of the first support leg 120 and the inner surface of the respective sidewall 116 of the fixing bracket 110, which can increase the friction between the side surface of the roller 151 and the fixing bracket 110 and the first support leg 120, and reduce the acceleration when the roller 151 is driven, so that the movement of the lower end portion 121 of the first support leg 120 is slower and more stable. Preferably, the roller 151 may be made of materials such as rubber, plastic, etc., to reduce damage to the fixing bracket 110 when the roller 121 moves. The shift 155 passes through the lower end portion 121 of the first support leg 120 and the two rollers 151, with its two end portions respectively received in the guiding slots 114 and extended outside the sidewalls 116. As such, when the lower end portion 121 of the first support leg 120 is driven move in the fixing bracket 110 back and forth, the shaft 155 moves along the guiding slots 114 of the fixing bracket 110 between the first end 114A and the second end 114B of the guiding slots 114 and the rollers 151 rotate on the bottom wall 115 of the fixing bracket 110 back and forth accordingly.

According to the invention, the bearing member 150 is designed such that the rollers 151 can bear all or some of the force or weight exerted on the lower end portion 121 of the first support leg 120 during operations of the lumbar support mechanism. In one embodiment, the rollers 151 are designed to have a radius such that when the shaft 155 is received in the guiding slot 114 and moves therein, the shaft 155 is slightly in contact with, or is not in contact with the lower edge 114C of the guiding slot 114. For example, the radius can be greater than H1 but less than H2, where H1 is a height of the lower edge 114C of the guiding slot 114 from the inner surface of the bottom wall 115, and H2 is a height of the upper edge 114C of the guiding slot 114 from the inner surface of the bottom wall 115, as shown in FIG. 1. Accordingly, such a design enables the lower end portion 121 of the first support leg 120 to move smoothly in the fixing bracket 110 when it is driven, and the rollers 151 to support the first support leg 120 when it is stationary. The friction between the shaft 155 and the lower edge 114C of the guiding slots 114 can be substantially reduced or completely eliminated when the shaft 155 moves the guiding slots 114 or is still in the guiding slots 114, thereby reducing or eliminating the friction caused damage on the lower edge 114C of the guiding slot 114, which enhances the comfort of the user, and prolongs the life of the lumbar lifting assembly.

In addition, the center region of the end surface of each rollers 151 near the inner surface of the sidewall 116 of the fixing bracket 110 protrudes outward to form a limit ring that wraps the end portions of the shaft 155. The limit ring is extended in the guiding slot 114, with its outer circumferential surface in contact with the lower and upper edges 114C and 114D of the guiding slot 114, so as to further limit the movement of the shaft 155 in the up and down direction.

In other embodiments, the bearing member 150 can be a sliding block pivotally connected to the lower end portion 121 of the first support leg 120 to facilitate the smooth movement of the lower end portion 121 of the first support leg 120 on the fixing bracket 110 and limit the sliding track of the sliding block. The sliding block can also be arranged on the left and right sides of the fixing bracket 110, and the sliding block is located on the corresponding side between the inner surface of the sidewall 116 of the fixing bracket 110 and the outer surface of the first support leg 120, at the same time, one sidewall of the sliding block abuts against the inner surface of the sidewalls 116 of the fixing bracket 110, and the other side wall abuts against the outer surface of the first support leg 120. The operations for the sliding block of the bearing member is same as that disclosed above for the rollers of the bearing member and will not be repeated herein.

Figure 3:
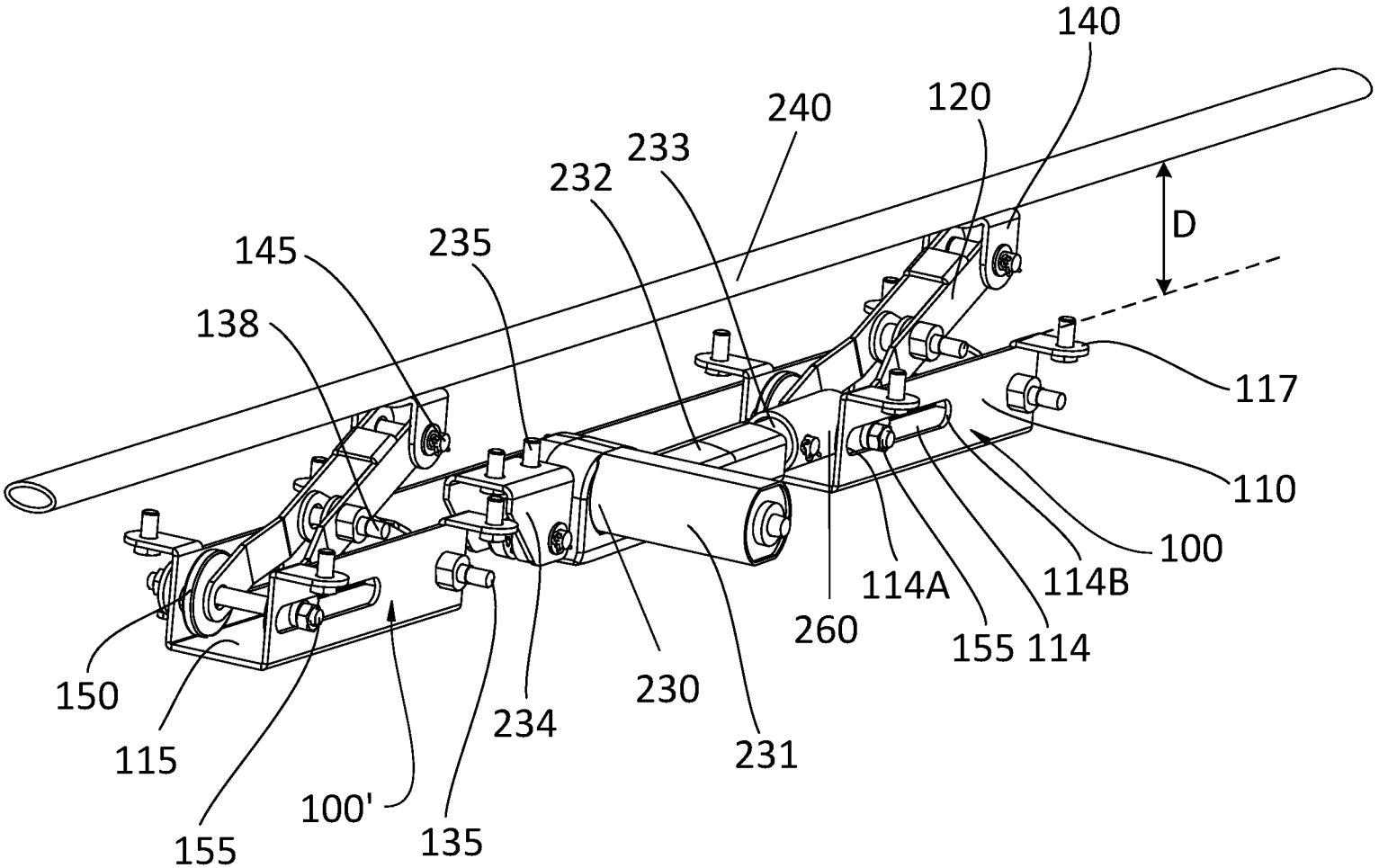
FIG. 3 shows schematically a perspective view of a lumbar support mechanism usable in an adjustable bed according to one embodiment of the invention.
Figure 4:
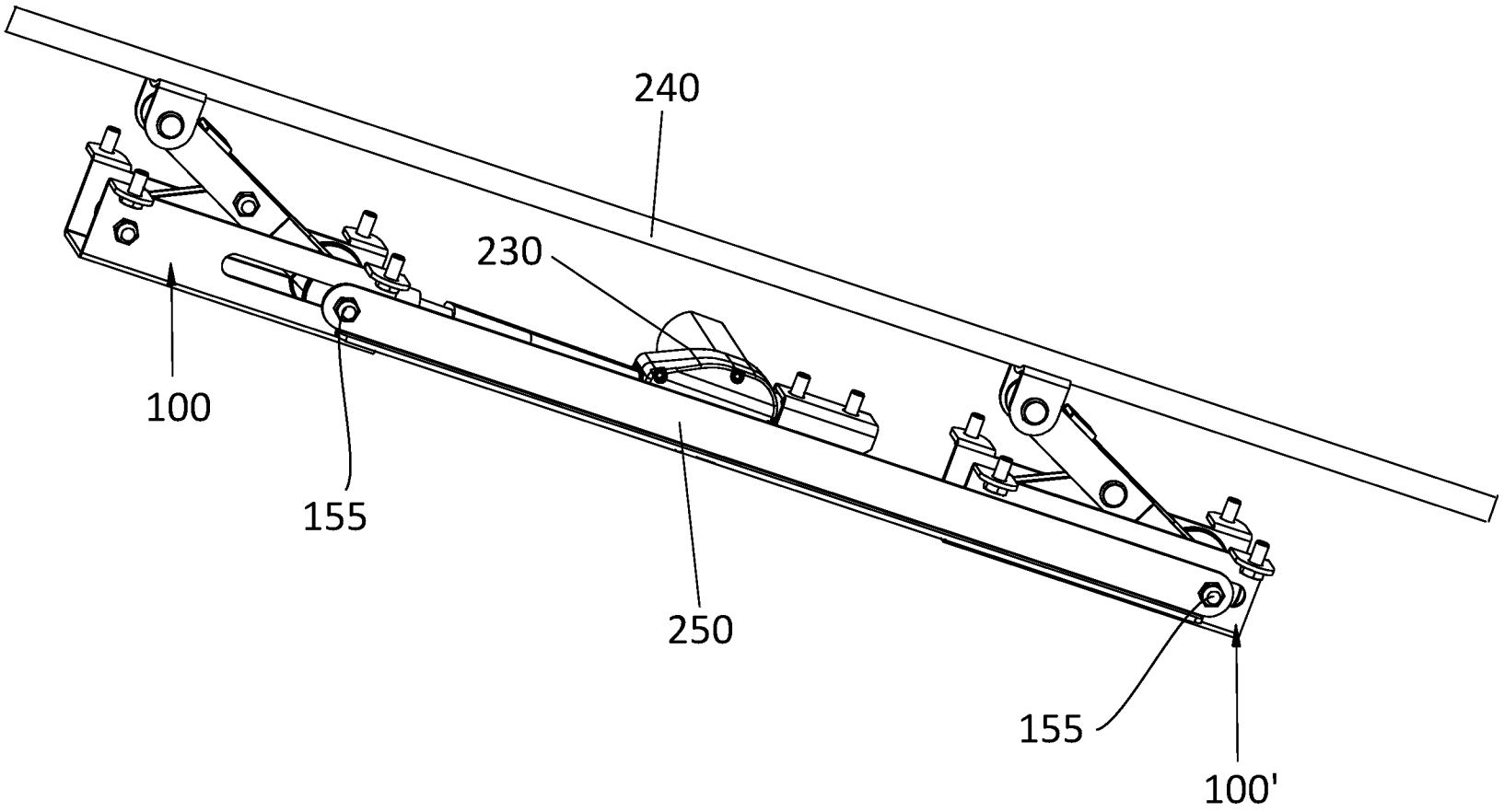
FIG. 4 shows schematically another perspective view of the lumbar support mechanism shown in FIG. 3.
Figure 5:
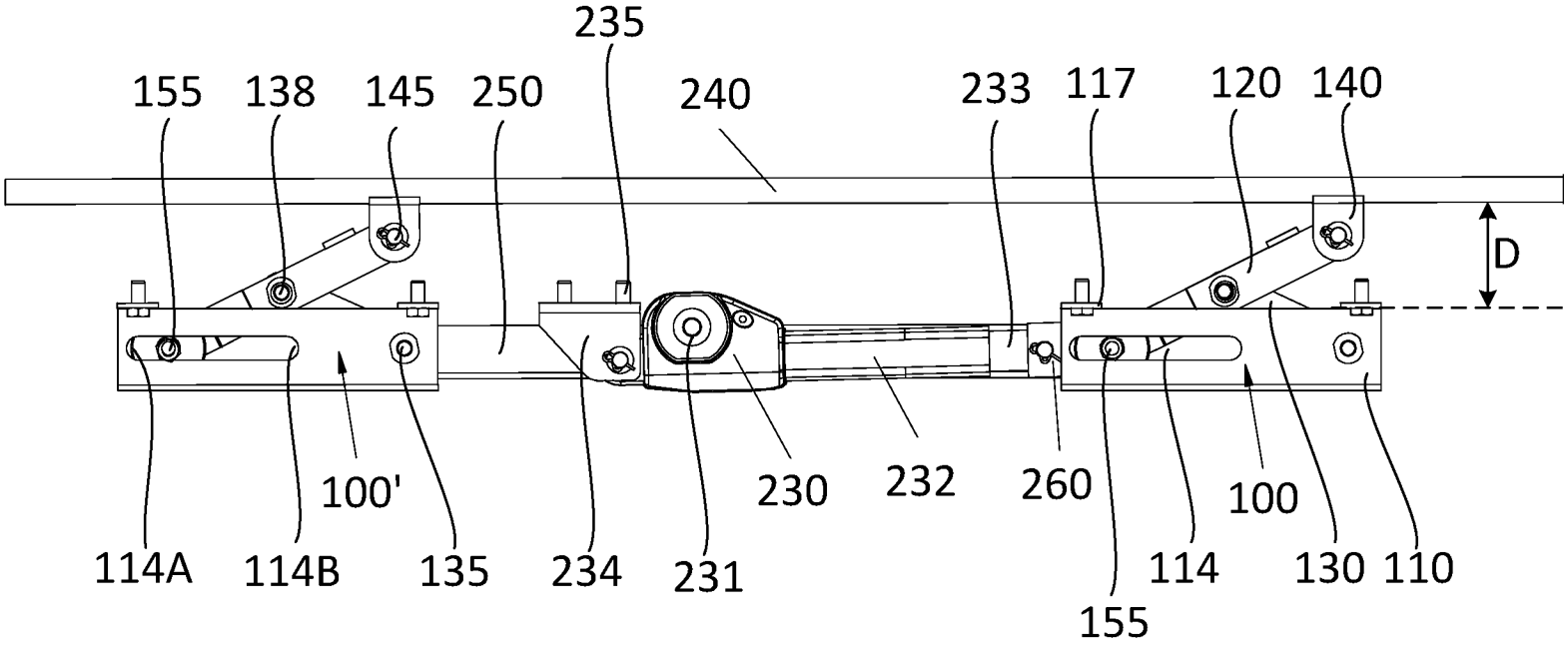
FIG. 5 shows schematically a side view of the lumbar support mechanism shown in FIG. 3.
Figure 6:
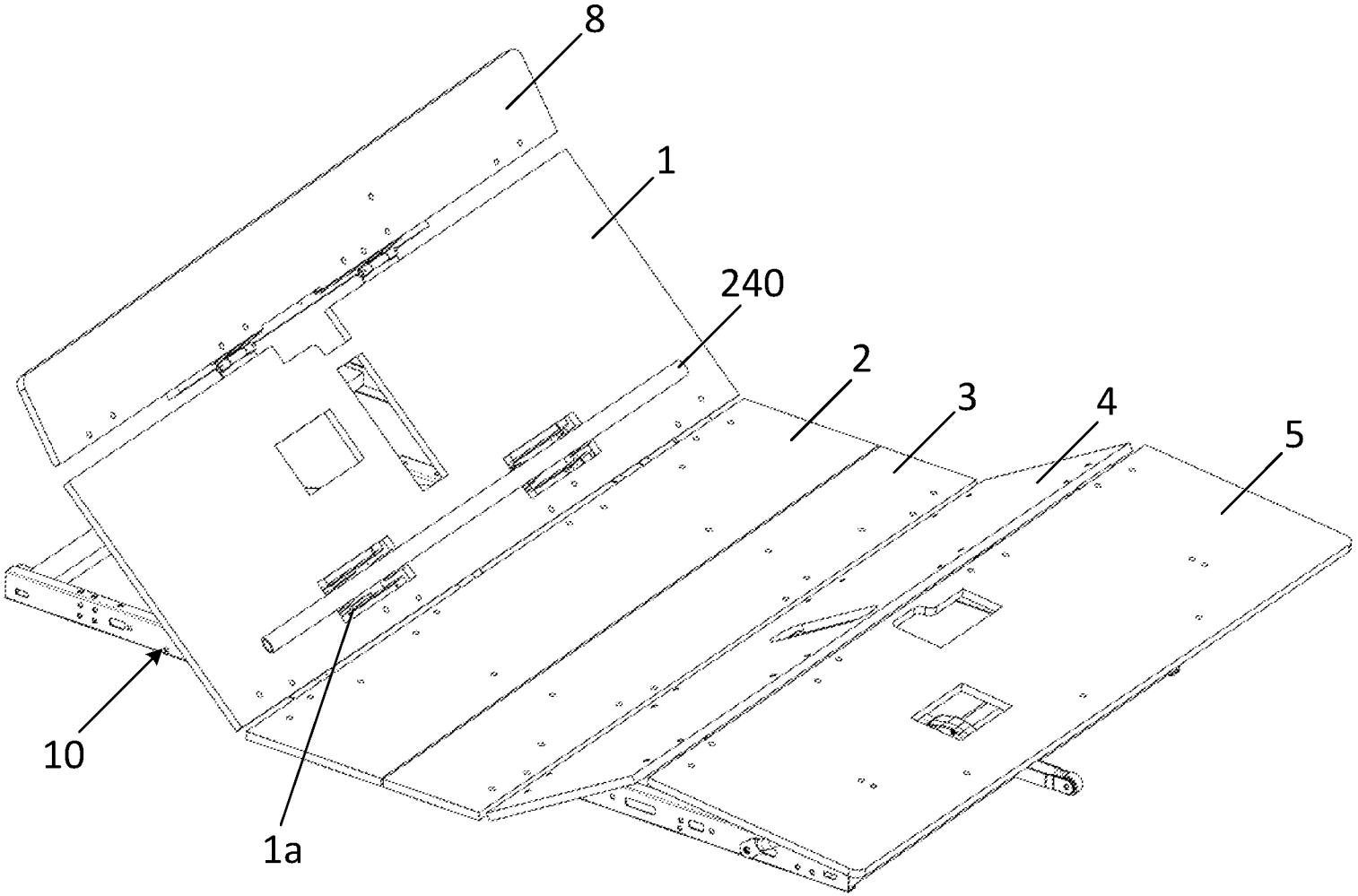
FIG. 6 shows schematically a front perspective view of an adjustable bed with a lumbar support mechanism in an adjusted state according to one embodiment of the invention.
Figure 7:
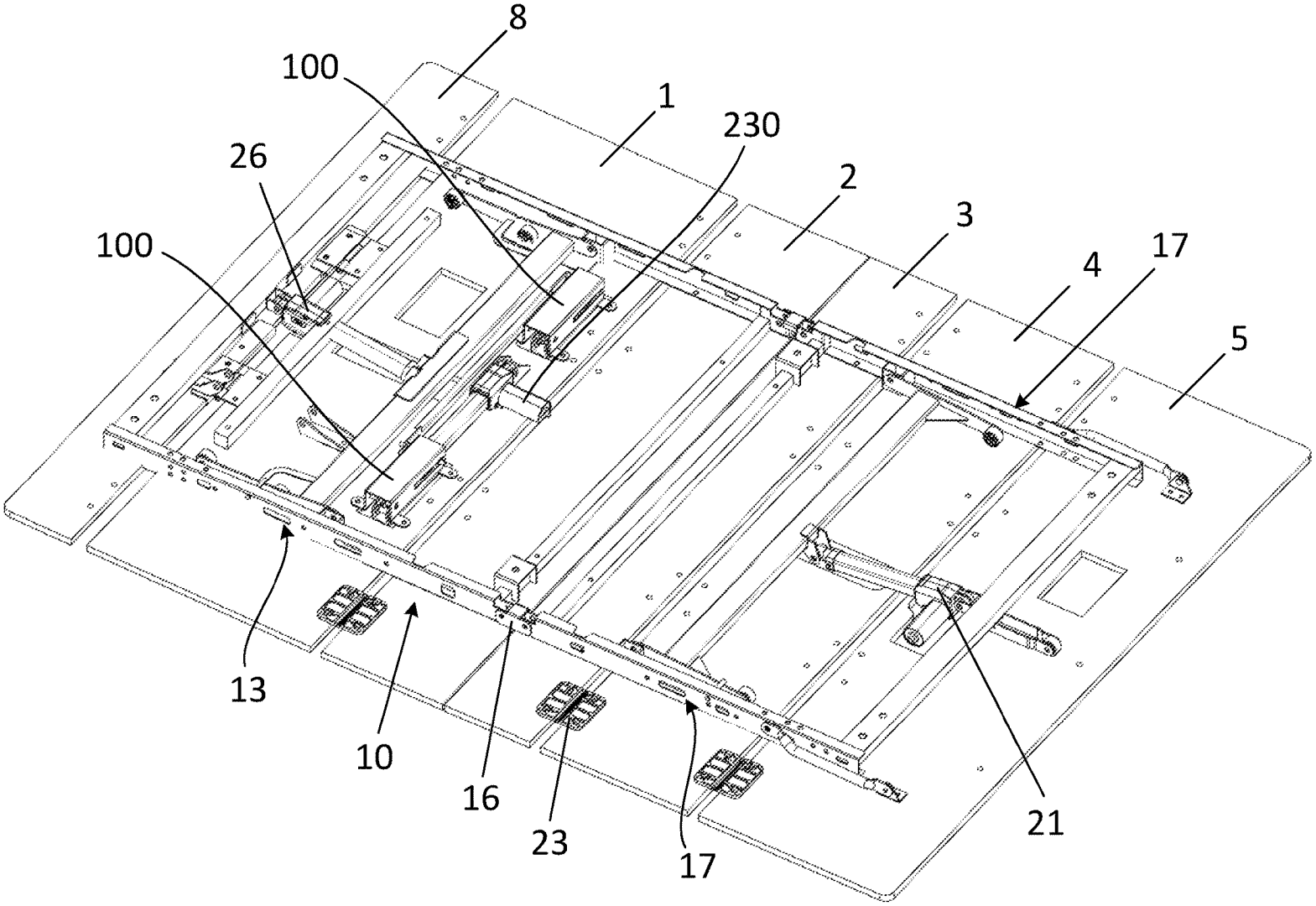
FIG. 7 shows schematically a back perspective view of the adjustable bed shown in FIG. 6 in a plane/flat state.
Figure 8:
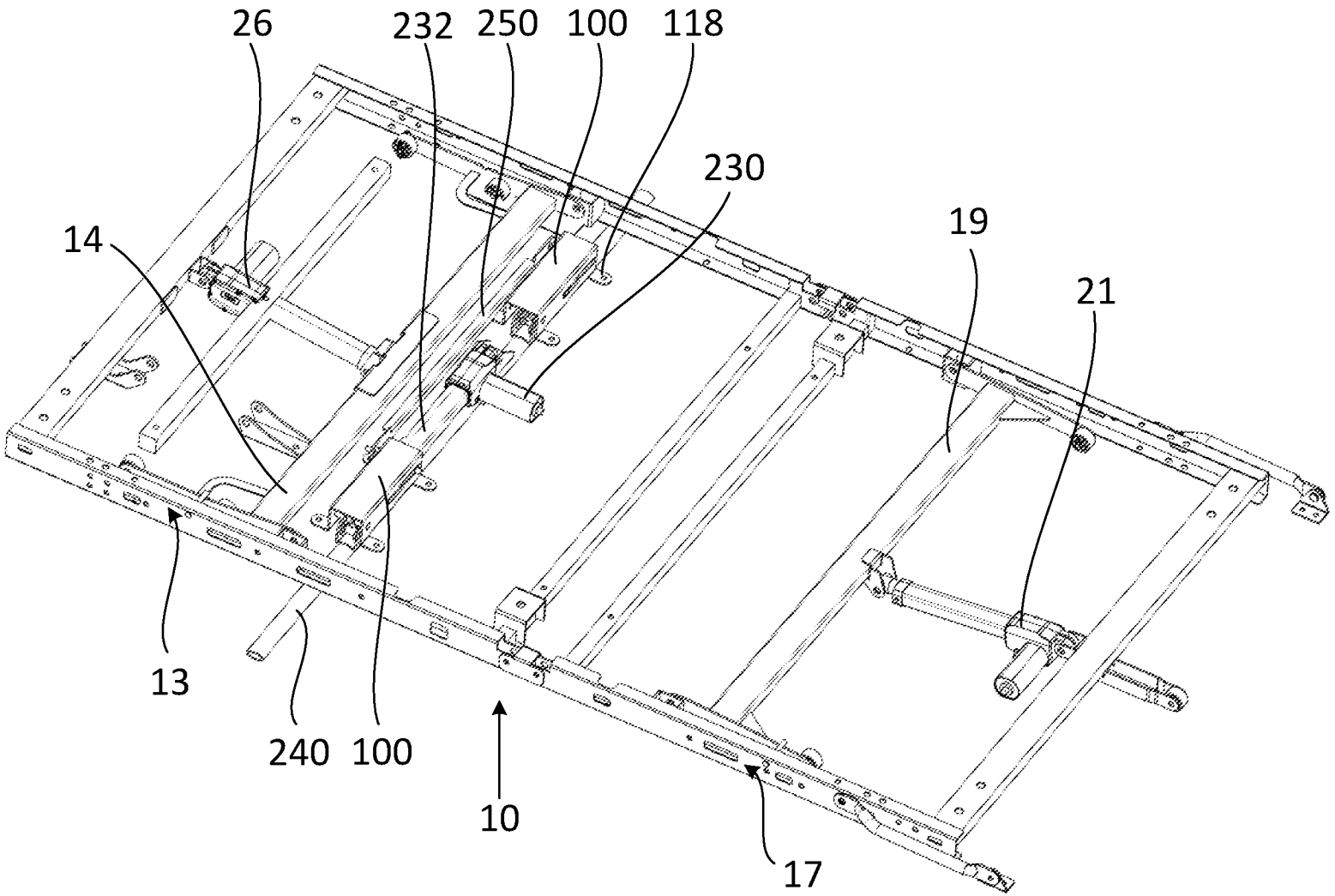
FIG. 8 shows schematically a structural view of the adjustable bed shown in FIG. 6.
Figure 9:
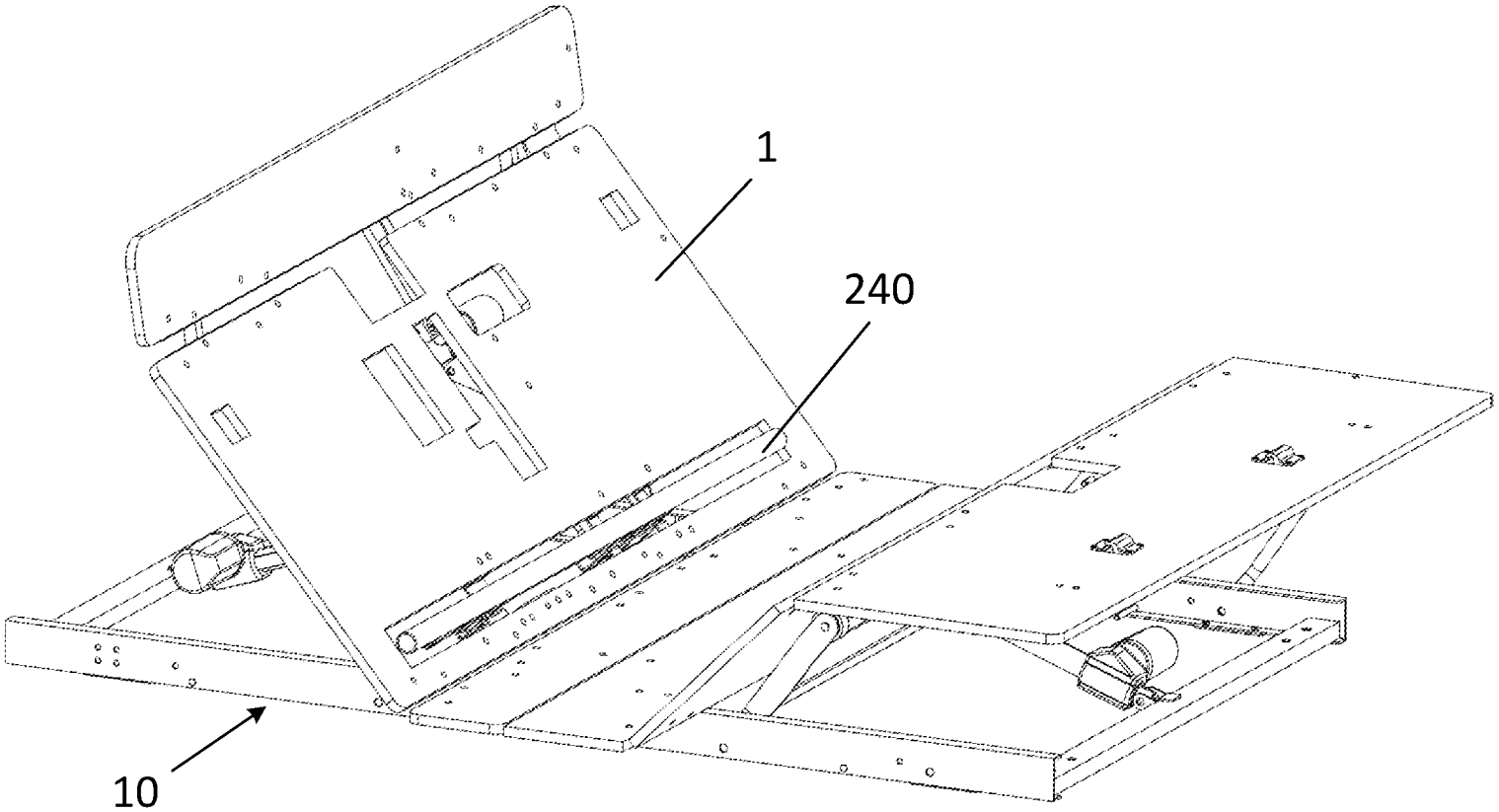
FIG. 9 shows schematically a front perspective view of an adjustable bed with a lumbar support mechanism in an adjusted state according to another embodiment of the invention.
Figure 10:
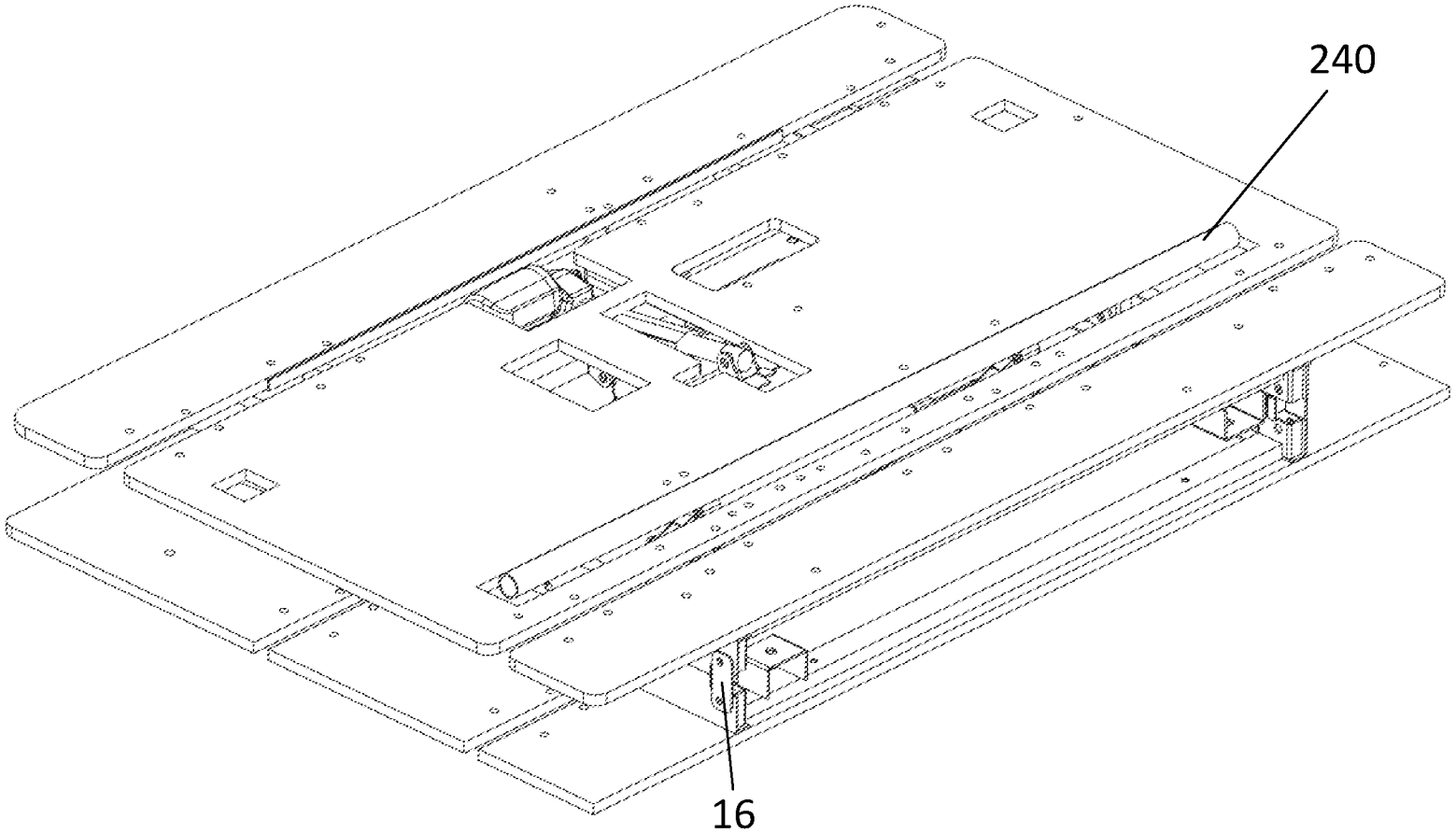
FIG. 10 shows schematically yet another front perspective view of the structural frame of the adjustable bed shown in FIG. 9 in a folded state.

As shown in FIGS. 3-5, the lumbar support member 240 is connected to the lifting support brackets 140 of the first lumbar lifting assembly 100 and the second lumbar lifting assembly 100'. The linkage member 250 is pivotally connected to the bearing member 150 of the first lumbar lifting assembly 100 and the second lumbar lifting assembly 100'.

As such, a distance, D, between the lumbar support member 240 and the lifting support brackets 140 of the first lumbar lifting assembly 100 and the second lumbar lifting assembly 100' is operably changeable between a minimal distance and a maximal distance when the linkage member 250 moves between a first position and a second position. In other words, the lumbar support member 240 is operably movable between a retracted position and an ejected (expanded) position when the linkage member 250 moves between the first and second positions. The lumbar support is provided when the lumbar support member 240 is in the ejected position.

Specifically, two end portions of the linkage member 250 are pivotally connected to the shafts 155 of the bearing members 150 of the first lumbar lifting assembly 100 and the second lumbar lifting assembly 100', respectively. When the shaft 155 moves to a first end 114A of the at least one guiding slot 114, the linkage member 250 moves to the first position and the lumbar support member 240 is in the retracted position, where the distance D between the lumbar support member 240 and the lifting support brackets 140 is the minimal distance. When the shaft 155 moves to an opposite, second end 114B of the at least one guiding slot 114, the linkage member 250 moves to the second position and the lumbar support member 240 is in the ejected position, where the distance D between the lumbar support member 240 and the lifting support brackets 140 is the maximal distance.

The lumbar support actuator 230 is operably connected to the bearing member 150 of one of the first lumbar lifting assembly 100 and the second lumbar lifting assembly 100' for operably driving the bearing members 150 so as to move the linkage member 250 between the first position and the second position. For example, the lumbar support actuator 230 is connected to the bearing member 150 of the first lumbar lifting assembly 100 in the embodiment shown in FIGS. 3-5. The lumbar support actuator 230 comprises a motor member 231, an outer tube 232 extending from the motor member 231, and an activation rod 233 received in the outer tube 232, engaged with the motor member 231 and configured to be telescopically movable relative to the outer tube 232 according to a rotation direction of the motor member 231. A distal (free) end of the activation rod 233 is pivotally connected to the lower end portion 121 of the first support leg 120, or pivotally connected to the shaft 155 of the bearing members 150 of the first lumbar lifting assembly 100. In other embodiments, the activation rod 233 can also be driven by hydraulic pressure or pneumatic pressure. The lumbar support actuator 230 also comprises a mounting bracket 234 connected to the motor member 231. The mounting bracket 234 is used to secure the lumbar support actuator 230 onto the back platform.

When the motor member 231 drives the activation rod 233 to make an extension motion, the extension motion drives the lower end portion 121 of the first support leg 120 and thus the shaft 155 to move forward, i.e., a direction of which the shaft 155 moves in the guiding slot 114 from the first end 114A to the second end 114B. The roller 151 rolls on the fixing bracket 110, and at the same time, the linkage member 250 drives the first support leg 120 of the second lifting assembly 100' to move synchronously with the first support leg 120 of the first lifting assembly 100, then the upper ends of the first support legs 120 of the first lifting assembly 100 and the second lifting assembly 100' are both lifted upward, and the lumbar support member 240 fixed on the lifting support brackets 140 pivotally connected to the upper ends of the first support legs 120 is lifted upward accordingly. When the driving motor 231 is stopped, the lumbar support member 240 is supported by the rollers 151 at the lower end 121 of the first support leg 120 and the lower end of the second support leg 130 of the first and second lifting assemblies 100 and 100'. During this process, the rolling of the rollers 151 of the first support leg 120 makes the lumbar support member 240 rise smoothly, and the rollers 151 at the lower end 121 of the first support leg 120 and the lower end of the second support leg 130 support the upper lumbar support member 240. This can reduce the damage to the guiding slot edge of the fixing bracket 110 and the shaft 155 in the lifting assemblies 100 and 200, prolong the life of the lifting assembly, and reduce the maintenance frequency of the lumbar support mechanism.

As disclosed above, in one embodiment, the rollers 151 are disposed on both sides of the fixing bracket 110, and located between the outer surface of the sidewall 116 of the first support leg 120 and the inner side surface of the fixing bracket 110 such that the outer wheel surfaces of the rollers 151 abut against the outer surface of the first support leg 120 and the inner surface of the sidewall 116 of the fixing bracket 110, respectively. This arrangement can limit the movement trajectory of the rollers 151, and at the same time, can increase the friction between the side surfaces of the rollers 151 and the sidewalls 116 of the fixing seat 10 and the first support leg 120, reduce the acceleration when the rollers 151 is driven, and thus enable the lumbar support member 240 to be more gentle in the process of being lifted. Further, the lumbar/waist of the user is supported on the lumbar support mechanism, which can improve the comfort of the user when the height of the lumbar support member 240 is changed, and enhance the user experience.

In addition, as shown in FIGS. 3 and 5, a connecting bracket 260 is provided for connecting the activation/push rod 233 of the motor member 231 and the shaft 155 of the lifting assembly 100. The connecting bracket 260 and the free end of the push rod 233 are detachably connected, while the connecting bracket 260 and the shaft 155 are pivotally connected. This arrangement, compared with direct connection of the push rod 233 to the lifting assembly 100, facilitates easily maintenance of the lumbar support mechanism. For example, when the driving motor 231 needs to be replaced, one only needs to disassemble the activation rod 233 of the driving motor 231 from the connecting bracket 260 to remove the driving motor 231, which avoids the need for disassembling the shaft 155 of the lifting assembly 100. In this embodiment, the connecting bracket 260 and the activation rod 233 of the driving motor 231, the connecting bracket 260 and the shaft 155 are all connected by a pin.

Referring to FIGS. 6-10, the adjustable bed utilizing the lumbar support mechanism disclosed above are shown according to embodiments of the invention. The structure and operations of the adjustable bed according to this invention are substantially similar to that of the adjustable bed disclosed in U.S. patent application Ser. No. 17/318,006, which is incorporated herein in its entirety by reference, except that the lumbar support mechanism are different. The brief description of the adjustable bed is discussed blow, while the detailed description of the structure and operations of the adjustable bed of the invention is referred to the disclosure of U.S. patent application Ser. No. 17/318,006.

The adjustable bed comprises a frame structure 10 having a back frame 13 and a foot frame 14; a plurality of platforms disposed on the frame structure, the plurality of platforms comprising at least a back platform having one or more opening 1*a* defined corresponding to a lumber portion of a user; and a lifting mechanism including a back lifting assembly and a leg lifting assembly positioned between the frame structure and the plurality of platforms for operably adjusting positions of at least one of the plurality of platforms so as to adjust the adjustable bed at a desired position; and a lumbar support mechanism received in the at least one opening of and secured to the back platform for operably providing lumbar support.

The lumbar support mechanism is disclosed above. The lumbar support member 240 is operably movable between a retracted position and an ejected position when the linkage member 250 moves between the first and second positions. The lumbar support is provided when the lumbar support member 240 is in the ejected position.

The plurality of platforms includes a head platform 8, a back platform 1 and an upper seat platform 2 mounted on the back frame 13. The upper seat platform 2 is hinged with the back platform 1 through hinges 23. The plurality of platforms also includes a lower seat platform 3 mounted on the foot frame 17, a thigh platform 4, and a leg platform 5. The lower seat platform 3 is hinged with the thigh platform 4 through hinges 23, and the thigh platform 4 is hinged with the leg platform 5 through hinges 23.

The back frame 13 includes an upper back frame rail, a lower back frame rail, and a pair of side back frame rails. The upper back frame rail and the lower back frame rail are longitudinally spaced and transversely extended, and the pair of side back frame rails is transversely spaced and longitudinally extended, and rigidly connected to the upper back frame rail and the lower back frame rail, such that the upper back frame rail and the lower back frame rail and the pair of side back frame rails are co-planar in a rectangle form. Preferably, the connection of the pair of side back frame rails to the upper and lower back frame rails and is by welding ends of the upper back frame rail onto end portions of the pair of side back frame rails, and welding ends of the lower back frame rail onto opposite end portions of the pair of side back frame rails. Other connecting means such as screw connections can also be utilized to practice the invention.

The back lifting assembly has a back lifting bracket 14 pivotally connected to the back frame 13, and a back lifting actuator pivotally connected between the back lifting bracket 14 and the back frame 13 for operably driving the back lifting bracket 14 to pivotally move in an upward rotating direction or a downward rotating direction relative to the back frame 13.

The back lifting bracket 14 includes a middle bar and a pair of swing arms. Each of the pair of swing arms is in an arc-shaped design. The pair of swing arms is transversely spaced and longitudinally extended, and rigidly connected to ends of the transversely extending middle bar in an H-shaped form. Each of the pair of swing arms has a first end portion and an opposite, second end portion. The first end portion of each swing arm is pivotally mounted to a respective one of the side back frame rails of the back frame 13 through a pivot. The second end portion of at least one of the swing arms is equipped with a first lifting wheel and a second lifting wheel. Practically, the second end portion of the swing arms may also be equipped with the first lifting wheel and the second lifting wheel. In addition, each of the pair of swing arms may be reinforced by a pair of reinforcing pieces rigidly connected to an end portion of the middle bar on either side.

The back lifting actuator includes a motor member 26, an outer tube extending from the motor member 26, and an activation rod received in the outer tube, engaged with the motor member 26 and configured to be telescopically movable relative to the outer tube according to a direction of motor rotation. The motor member 26 is pivotally connected to the upper back frame rail of the back frame 13 through a first bracket. The activation rod has a distal end portion pivotally connected to the middle bar of the back lifting bracket 14 through a second bracket. Accordingly, when the activation rod is expanded, it drives the back lifting bracket 14 to rotate in an upward rotation direction along the pivot point at in the first end portion of each swing arm of the back lifting bracket 14, which in turn causes the back platform 1 to sildably move against the back lifting wheels in the same upward rotation direction. When the activation rod is contracted, it drives the back lifting bracket 14 to rotate in an downward rotation direction along the pivot point at the first end portion of each swing arm of the back lifting bracket 14, which in turn causes the back platform 1 to sildably move against the back lifting wheels in the same downward rotation direction.

The foot frame 17 includes an upper foot frame rail, a lower foot frame rail, and a pair of side foot frame rails. The upper foot frame rail and the lower foot frame rail are longitudinally spaced and transversely extended, and the pair of side foot frame rails is transversely spaced and longitudinally extended, and rigidly connected to the upper foot frame rail and the lower foot frame rail, such that the upper foot frame rail and the lower foot frame rail and the pair of side foot frame rails are co-planar in a rectangle form. Preferably, the connection of the pair of side foot frame rails to the upper and lower foot frame rails and is by welding ends of the upper foot frame rail onto end portions of the pair of side foot frame rails, and welding ends of the lower foot frame rail onto opposite end portions of the pair of side foot frame rails. Other connecting means such as screw connections can also be utilized to practice the invention.

The foot lifting assembly has a foot lifting bracket 19 pivotally connected to the foot frame 17, and a foot lifting actuator pivotally connected between the foot lifting bracket 19 and the foot frame 17 for operably driving the foot lifting bracket 19 to pivotally move in an upward rotating direction or a downward rotating direction relative to the foot frame 17.

The foot lifting bracket 19 includes a middle bar and a pair of swing arms. The pair of swing arms is transversely spaced and longitudinally extended, and rigidly connected to ends of the transversely extending middle bar in an H-shaped form. Each of the pair of swing arms has a first end portion and an opposite, second end portion. The first end portion of each swing arm or 19*c* is pivotally mounted to a respective one of the side foot frame rails of the foot frame 17 through a pivot. The second end portion of at least one of the swing arms is equipped with a foot lifting wheel. Practically, the second end portion of the swing arms may also be equipped with the foot lifting wheel. In addition, each of the pair of swing arms may be reinforced by a reinforcing piece rigidly connected to each end portion of the middle bar.

The foot lifting actuator includes a motor member 21, an outer tube extending from the motor member 21, and an activation rod received in the outer tube, engaged with the motor member 21 and configured to be telescopically movable relative to said outer tube according to a direction of motor rotation. The motor member 21 is pivotally connected to the upper foot frame rail of the foot frame 17 through a first bracket. The activation rod has a distal end portion pivotally connected to the middle bar of the foot lifting bracket 19 through a second bracket. As such, when the activation rod is expanded, it drives the foot lifting bracket 19 to rotate in an upward rotation direction along the pivot point at in the first end portion of each swing arm of the foot lifting bracket 19, which in turn causes the thigh platform 4 to sildably move against the foot lifting wheels 20 in the same upward rotation direction. The movement of the thigh platform 4 in the same upward rotation direction in turn causes the foot platform 5 to move accordingly, so that the thigh platform 4 and the foot platform 5 are in a desired adjusting position. When the activation rod is contracted, it drives the foot lifting bracket 19 to rotate in an downward rotation direction along the pivot point at in the first end portion of each swing arm of the foot lifting bracket 19, which in turn causes the thigh platform 4 to sildably move against the foot lifting wheels in the same downward rotation direction. The movement of the thigh platform 4 in the same downward rotation direction in turn causes the foot platform 5 to move, so that the thigh platform 4 and the foot platform 5 are in a flat position when the activation rod is contracted at most.

In addition, the folding mechanism 16 connects the back frame 13 and the foot frame 17 such that the back frame 13 and the foot frame 17 are pivotally foldable to one another at the folding mechanism 16. Preferably, the folding mechanism 16 is a hinge bracket, as shown in FIGS. 6-10. Other connecting means and other types of folding mechanism can also be utilized to practice the invention.

The adjustable bed also includes a controller electrically coupled to the back lifting actuators (motors), the leg lifting actuators (motors), the head tilt actuators (motors) and the lumbar support actuators (motors), so as to lift individually or cooperatively the head and back platforms 8 and 1, the thigh platform 4, and the leg platform 5 in desired positions, and to provide the massage effects to the user. A user lying on the adjustable bed can make adjustments as desired.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A lumbar support mechanism usable in an adjustable bed, comprising:

a first lumbar lifting assembly and a second lumbar lifting assembly, each of the first and second lumbar lifting assemblies comprising:

a fixing bracket, a first support leg, a second support leg, a bearing member, and a lifting support bracket, wherein the fixing bracket is operably attachable to a back platform of the adjustable bed;

wherein the first support leg has a lower end portion pivotally connected to the bearing member that is operably movable in the fixing bracket, and an upper portion pivotally connected to the lifting support bracket; and wherein the second support leg has a lower end portion pivotally connected to the fixing bracket, and an upper end portion pivotally connected to a middle portion of the first support leg;

a lumbar support member connected to the lifting support brackets of the first lumbar lifting assembly and the second lumbar lifting assembly; and a linkage member pivotally connected to the bearing member of the first lumbar lifting assembly and the second lumbar lifting assembly, such that a distance between the lumbar support member and the lifting support brackets of the first lumbar lifting assembly and the second lumbar lifting assembly is operably changeable between a minimal distance and a maximal distance when the linkage member moves between a first position and a second position.

2. The lumbar support mechanism of claim 1, wherein the fixing bracket has a bottom wall, two sidewalls vertically extended from two opposite edges of the bottom wall, a plurality of mounting tabs horizontally extended from tops of the sidewalls, and at least one guiding slot formed in at least one of the sidewalls and being parallel to the bottom wall.

3. The lumbar support mechanism of claim 2, wherein the bearing member is operably movable on the bottom wall of the fixing bracket.

4. The lumbar support mechanism of claim 3, wherein the bearing member comprises at least one sliding block.

5. The lumbar support mechanism of claim 3, wherein the bearing member comprises at least one roller disposed between the lower end portion of the first support leg and the at least one of the sidewalls of the fixing bracket, and a shaft connected to the at least one roller and the lower end portion of the first support leg as a pivot and movably received in the at least one guiding slot of the fixing bracket, such that when the lower end portion of the first support leg is driven to move in the fixing bracket, the shaft moves along the at least one guiding slot of the fixing bracket and the at least one roller rotates on the bottom wall of the fixing bracket.

6. The lumbar support mechanism of claim 5, wherein two end portions of the linkage member are pivotally connected to the shafts of the bearing members of the first lumbar lifting assembly and the second lumbar lifting assembly, respectively, such that when the shaft moves to a first end of the at least one guiding slot, the linkage member moves to the first position, when the shaft moves to an opposite, second end of the at least one guiding slot, the linkage member moves to the second position.

7. The lumbar support mechanism of claim 1, further comprising a lumbar support actuator operably connected to the bearing member of one of the first lumbar lifting assembly and the second lumbar lifting assembly for operably driving the bearing members so as to move the linkage member between the first position and the second position.

8. The lumbar support mechanism of claim 7, wherein the lumbar support actuator comprises a motor member, an outer tube extending from the motor member, and an activation rod received in the outer tube, engaged with the motor member and configured to be telescopically movable relative to the outer tube according to a rotation direction of the motor member.

9. The lumbar support mechanism of claim 8, wherein the lumbar support actuator further comprises a mounting bracket connected to the motor member and configured to attach to the back platform, and wherein a distal end of the activation rod is pivotally connected to the lower end portion of the first support leg, or pivotally connected to the shaft of said one of the bearing members of the first lumbar lifting assembly and the second lumbar lifting assembly.

10. An adjustable bed, comprising:

a frame structure having a back frame and a foot frame;

a plurality of platforms disposed on the frame structure, the plurality of platforms comprising at least a back platform having at least one opening; and a lifting mechanism positioned between the frame structure and the plurality of platforms for operably adjusting positions of at least one of the plurality of platforms so as to adjust the adjustable bed at a desired position; and a lumbar support mechanism received in the at least one opening of and secured to the back platform for operably providing lumbar support, wherein the lumbar support mechanism comprises:

a first lumbar lifting assembly and a second lumbar lifting assembly, each of the first and second lumbar lifting assemblies comprising:

a fixing bracket, a first support leg, a second support leg, a bearing member, and a lifting support bracket, wherein the fixing bracket is secured to the back platform;

wherein the first support leg has a lower end portion pivotally connected to the bearing member that is operably movable in the fixing bracket, and an upper portion pivotally connected to the lifting support bracket; and wherein the second support leg has a lower end portion pivotally connected to the fixing bracket, and an upper end portion pivotally connected to a middle portion of the first support leg;

a lumbar support member connected to the lifting support brackets of the first lumbar lifting assembly and the second lumbar lifting assembly;

a linkage member pivotally connected to the bearing member of the first lumbar lifting assembly and the second lumbar lifting assembly; and a lumbar support actuator pivotally connected to the bearing member of one of the first lumbar lifting assembly and the second lumbar lifting assembly for operably driving the bearing members so as to move the linkage member between a first position and a second position, wherein the lumbar support member is operably movable between a retracted position and an ejected position when the linkage member moves between the first and second positions, and wherein the lumbar support is provided when the lumbar support member is in the ejected position.

11. The adjustable bed of claim 10, wherein the fixing bracket has a bottom wall, two sidewalls vertically extended from two opposite edges of the bottom wall, a plurality of mounting tabs horizontally extended from tops of the sidewalls, and at least one guiding slot formed in at least one of the sidewalls and being parallel to the bottom wall, and wherein the bearing member is operably movable on the bottom wall of the fixing bracket.

12. The adjustable bed of claim 11, wherein the bearing member comprises at least one roller disposed between the lower end portion of the first support leg and the at least one of the sidewalls of the fixing bracket, and a shaft connected to the at least one roller and the lower end portion of the first support leg as a pivot and movably received in the at least one guiding slot of the fixing bracket, such that when the lower end portion of the first support leg is driven to move in the fixing bracket, the shaft moves along the at least one guiding slot of the fixing bracket and the at least one roller rotates on the bottom wall of the fixing bracket.

13. The adjustable bed of claim 12, wherein two end portions of the linkage member are pivotally connected to the shafts of the bearing members of the first lumbar lifting assembly and the second lumbar lifting assembly, respectively, such that when the shaft moves to a first end of the at least one guiding slot, the linkage member moves to the first position, when the shaft moves to an opposite, second end of the at least one guiding slot, the linkage member moves to the second position.

14. The adjustable bed of claim 13, wherein the lumbar support actuator comprises a motor member, an outer tube extending from the motor member, an activation rod received in the outer tube, engaged with the motor member and configured to be telescopically movable relative to the outer tube according to a rotation direction of the motor member, and a mounting bracket connected to the motor member and configured to attach to the back platform, and wherein a distal end of the activation rod is pivotally connected to the lower end portion of the first support leg, or pivotally connected to the shaft of said one of the bearing members of the first lumbar lifting assembly and the second lumbar lifting assembly.

15. The adjustable bed of claim 14, wherein the lifting mechanism comprises a back lifting assembly and a leg lifting assembly, wherein the back lifting assembly comprises a back lifting bracket pivotally connected to the back frame, and a back lifting actuator pivotally connected between the back lifting bracket and the back frame for operably driving the back lifting bracket to pivotally move in an upward rotating direction or a downward rotating direction relative to the back frame; and wherein the foot lifting assembly comprises a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction relative to the foot frame.

16. The adjustable bed of claim 15, wherein the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the back frame and the second end portion of the activation rod pivotally connected to the back lifting bracket, or wherein the motor member is pivotally connected to the back lifting bracket and the second end portion of the activation rod pivotally connected to the back frame.

17. The adjustable bed of claim 15, wherein the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the leg frame and the second end portion of the activation rod pivotally connected to the leg lifting bracket, or wherein the motor member is pivotally connected to the leg lifting bracket and the second end portion of the activation rod pivotally connected to the leg frame.

* * * * *